US008764491B2

(12) United States Patent
Wang et al.

(10) Patent No.: US 8,764,491 B2
(45) Date of Patent: Jul. 1, 2014

(54) PLUG CONNECTOR HAVING AN IMPROVED HOUSING AND METHOD OF MAKING THE SAME

(75) Inventors: Chien-Chiung Wang, New Taipei (TW); Qing-Man Zhu, Kunshan (CN); Peng Zhai, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 142 days.

(21) Appl. No.: 13/340,615

(22) Filed: Dec. 29, 2011

(65) Prior Publication Data

US 2012/0171903 A1 Jul. 5, 2012

(30) Foreign Application Priority Data

Dec. 30, 2010 (CN) ..... 2010 2 0691514

(51) Int. Cl.
*H01R 24/00* (2011.01)

(52) U.S. Cl.
USPC ..... 439/660

(58) Field of Classification Search
USPC ..... 439/660, 152, 153, 160, 352, 686, 687, 439/696, 712, 607.41, 607.42, 607.44, 439/607.46, 607.47
See application file for complete search history.

(56) References Cited

U.S. PATENT DOCUMENTS

| | | | | |
|---|---|---|---|---|
| 7,883,341 | B2 | 2/2011 | Lang et al. | |
| 2010/0130063 | A1* | 5/2010 | Lang et al. | 439/607.17 |
| 2011/0183535 | A1* | 7/2011 | Wu | 439/153 |
| 2011/0195586 | A1* | 8/2011 | Wu | 439/152 |
| 2012/0052714 | A1* | 3/2012 | Zerebilov et al. | 439/370 |
| 2012/0171879 | A1* | 7/2012 | Wang et al. | 439/160 |
| 2012/0214350 | A1* | 8/2012 | Wu | 439/676 |

* cited by examiner

*Primary Examiner* — Renee Luebke
*Assistant Examiner* — Harshad Patel
(74) *Attorney, Agent, or Firm* — Wei Te Chung; Ming Chieh Chang

(57) ABSTRACT

A plug connector (100) includes a paddle board (21) and a housing having a first and a second housing portions (11, 12). The first housing portion includes a first side wall (1111) defining a first channel (112*a*), a second side wall (1112) defining a second channel (112*b*), and a cavity (13) defined between the front portion of the first side wall and the second side wall. The first channel has a rear portion exposed outwardly of the cavity for guiding the paddle board. The second housing portion is engaged with the first housing portion along a left-to-right direction to be in alignment with the second side wall for positioning the paddle board between the first and second housing portions.

17 Claims, 7 Drawing Sheets

PLUG CONNECTOR HAVING AN IMPROVED HOUSING AND METHOD OF MAKING THE SAME

CROSS-REFERENCE TO RELATED APPLICATIONS

This patent application is related to U.S. patent application Ser. No. 13/340,612, filed on Dec. 29, 2011, now Pat. No. 8,475,199, and entitled "PLUG CONNECTOR HAVING AN IMPROVED RELEASING MECHANISM", which is invented by the same inventors as this patent application and assigned to the same assignee with this application.

BACKGROUND OF THE INVENTION

1. Field of the Invention

The present invention generally relates to a plug connector and a method of making the same, and more particularly to a plug connector for application in high speed signal transmission and method of making the same.

2. Description of Related Art

U.S. Pat. No. 7,883,341 issued to Lang et al. on Feb. 8, 2011 discloses a plug connector for mating with a complementary connector. The plug connector comprises a housing, a pair of paddle boards, a card support, and a releasing mechanism assembled to the housing. The housing includes an upper housing and a lower housing engaged with each other along an up-to-bottom direction to define a receiving space therebetween. The card support defines a plurality of channels and is received in a notch of the housing. The pair of paddle boards are inserted in the channels and are received in the receiving space by the support. Optionally, the support can be integral with the housing. For example, the upper and lower housings may have retaining features formed in the location where the notches are provided. The paddle boards are positioned by retaining features. As can be appreciated, three or more boards can be aligned in a similar manner.

A plug connector having a differently configured housing is desired.

BRIEF SUMMARY OF THE INVENTION

Accordingly, an object of the present invention is to provide a plug connector having an improved housing supporting a paddle board directly and a method of making the same.

In order to achieve the above-mentioned object, a plug connector comprises at least a paddle board and a housing. The first housing portion includes a first side wall defining at least one first channel, a second side wall opposite to the first side wall and defining at least one second channel, and a cavity defined between the front portion of the first side wall and the second side wall. The at least one first channel has a front portion exposed to the cavity and a rear portion exposed outwardly of the cavity. The at least one paddle board is guided by the rear portion of the at least one first channel and inserted into the cavity along the at least one first channel and the at least one second channel. The second housing portion is engaged with the first housing portion along a left-to-right direction to be in alignment with the second side wall for positioning the at least one paddle board between the first and second housing portions.

A method of assembling a plug connector comprising the steps of providing a first housing portion including a first side wall defining at least one first channel, an opposite second side wall defining at least one second channel and a cavity between the first side wall and the second side wall. The at least one first channel has a front portion exposed to the cavity and a rear portion exposed outwardly of the cavity. Guidingly inserting the at least one paddle board via the rear portion of the at least one first channel into the cavity along the at least one first channel and the at least one second channel. Engaging a second housing portion with the first housing portion along a left-to-right direction for to confine of the at least one paddle board between the first and second housing portions.

The paddle boards could be inserted along the first and second channels of the first housing portion easily via the guiding of the first channels.

Other objects, advantages and novel features of the invention will become more apparent from the following detailed description of the present embodiment when taken in conjunction with the accompanying drawings.

DETAILED DESCRIPTION OF THE INVENTION

Figure 1:
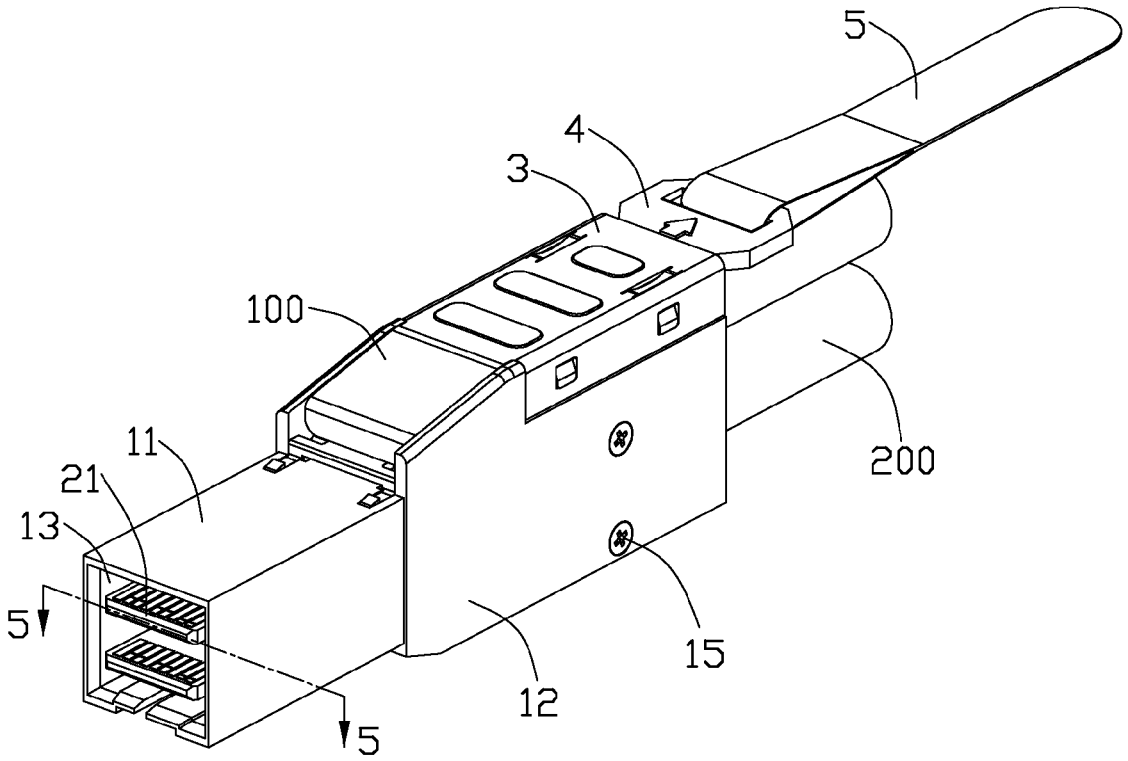
FIG. 1 is an assembled perspective view of a plug connector in accordance with a first embodiment of the present invention.

Reference will now be made to the drawing figures to describe the present invention in detail.

Referring to FIGS. 1-5, a plug connector 100 mating with a complimentary connector (not shown) in accordance with a first embodiment of the present invention comprises a housing, two circuit boards 21 each connected with a cable 200, a releasing mechanism assembled to the housing, a cover 3 attached to the housing, and a plurality of pins 16. If desired, the cable 200 can be replaced by other suitable structures or interfaces.

The housing comprises a first housing portion 11 and a second housing portion 12 engaged with each other. Both the first housing portion 11 and the second housing portion 12 are preferably die-casted.

Figure 2:
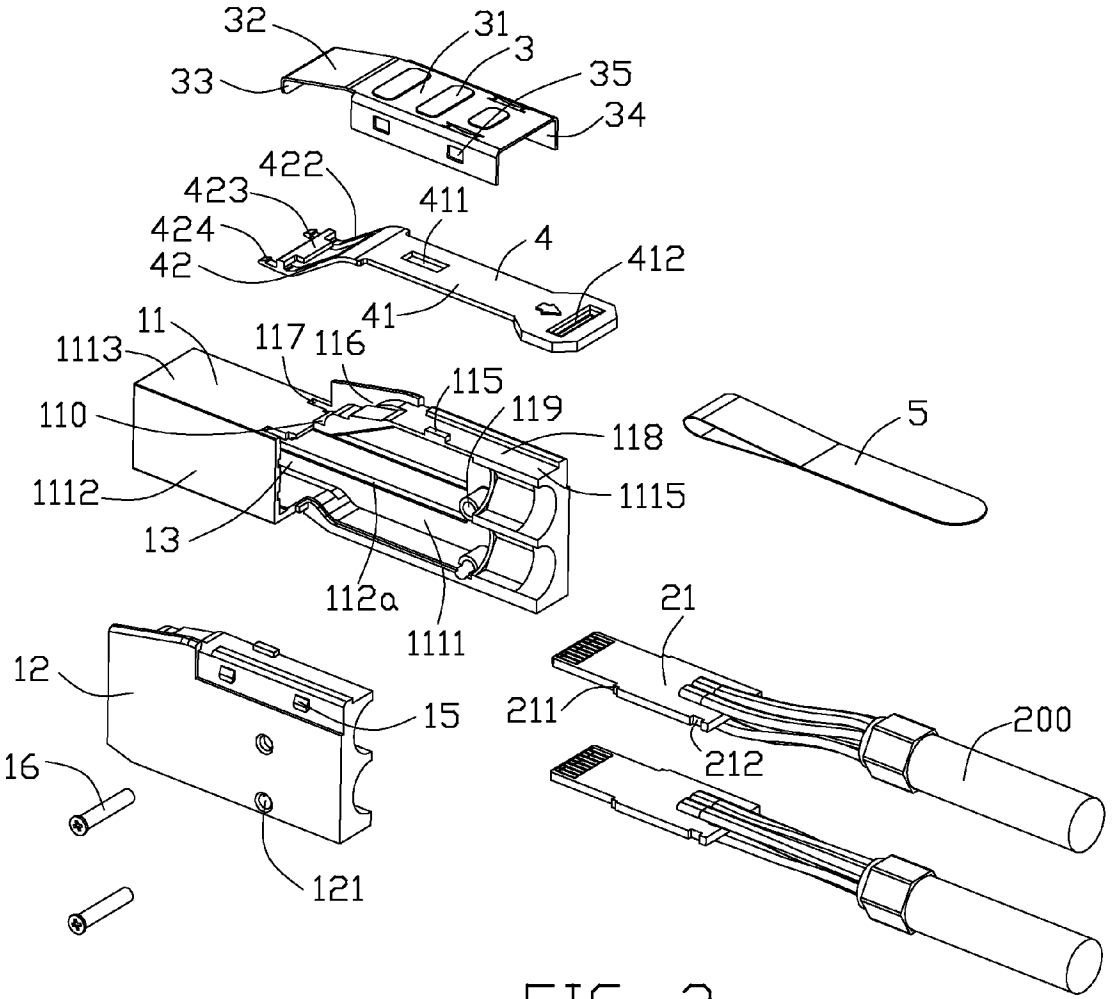
FIG. 2 is an exploded perspective view of the plug connector as shown in FIG. 1.
Figure 4:
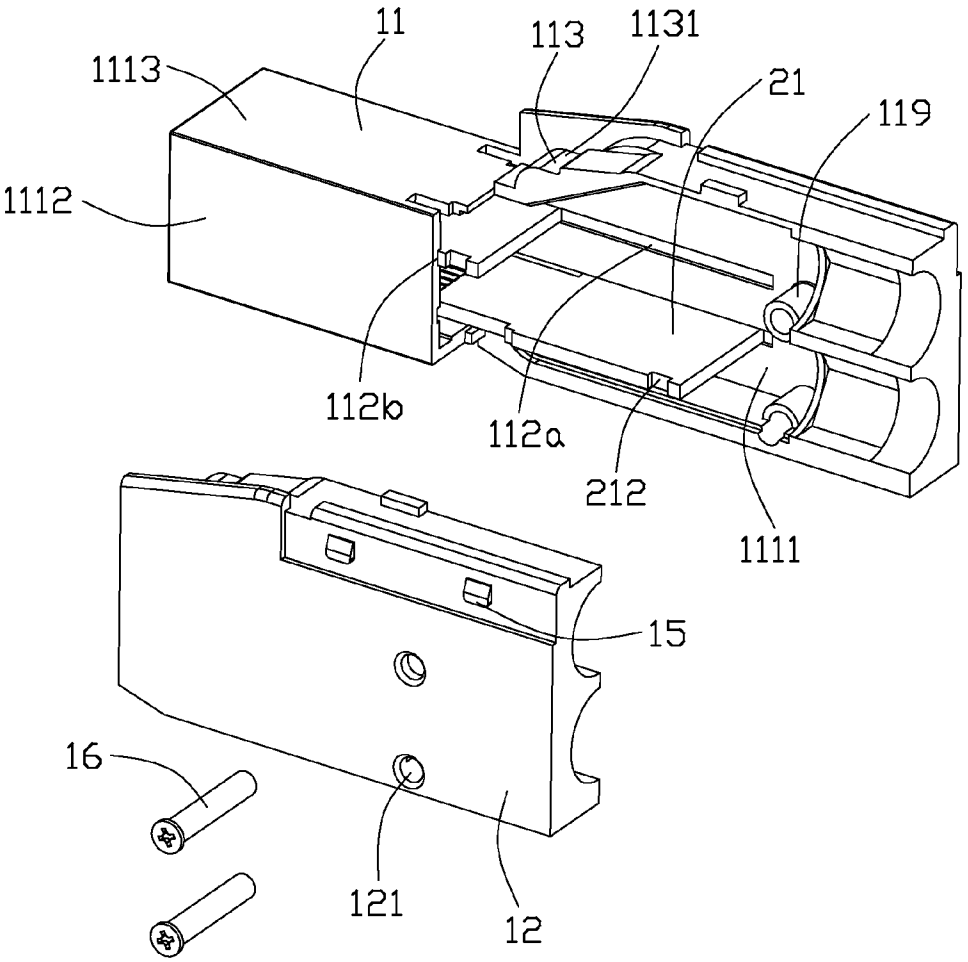
FIG. 4 is a perspective view showing two paddle boards inserted in the first housing portion.
Figure 5:
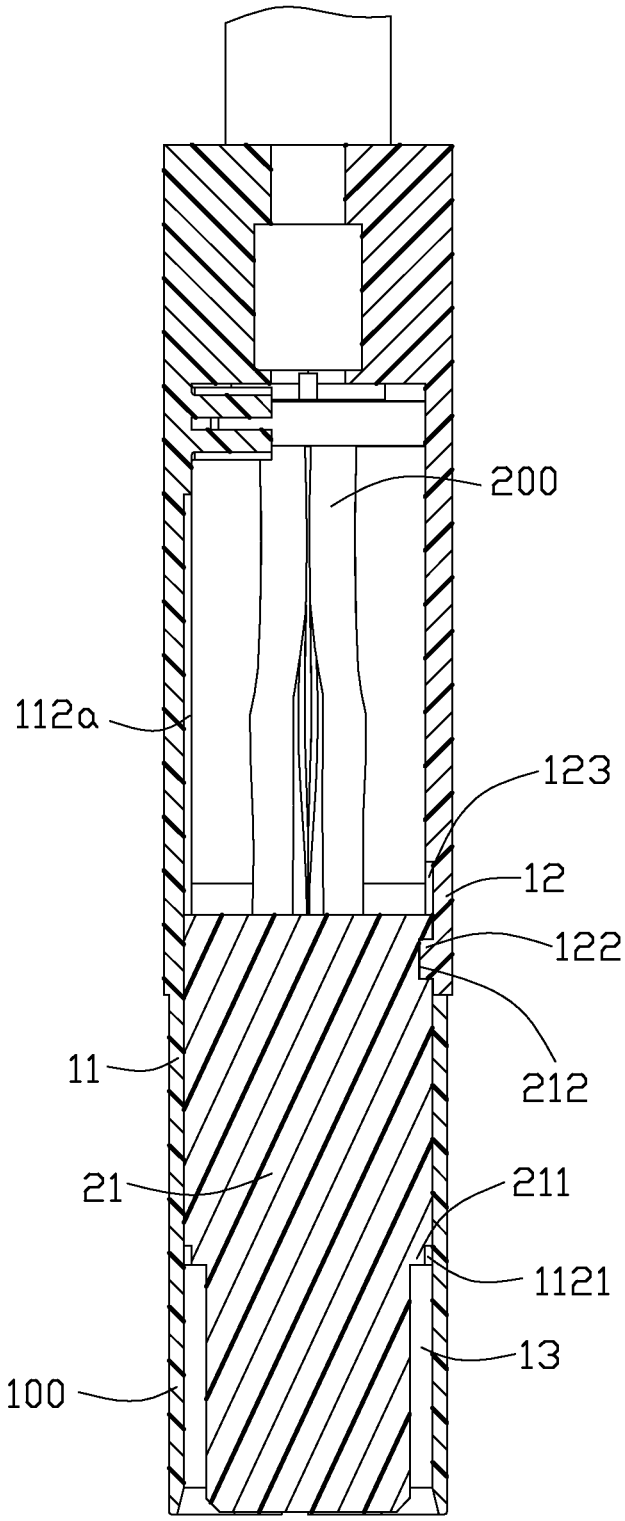
FIG. 5 is a cross-sectional view of the plug connector, taken along line 5-5 of FIG. 1.

Referring to FIGS. 2, 4 and 5, the first housing portion 11 includes a first side wall 1111, a second side wall 1112 opposite to a front portion of the first side wall 1111, and a cavity 13 defined between the front portion of the first side wall 1111 and the second side wall 1112 to receive the two paddle boards 21. The first side wall 1111 of the first housing portion 11 defines two first channels 112*a* each having a front portion exposed to the cavity 13 and a rear portion exposed outwardly of the cavity 13. The second side wall 1112 of the first housing portion 11 defines two second channels 112*b* exposed to the cavity 13. In conjunction with FIG. 5, each of the first channel 112*a* and the second channel 112*b* has a blocking portion 1121. The first side wall 1111 of the first housing portion 11 further includes two locking posts 119 projecting toward the second housing portion 12.

Figure 3:
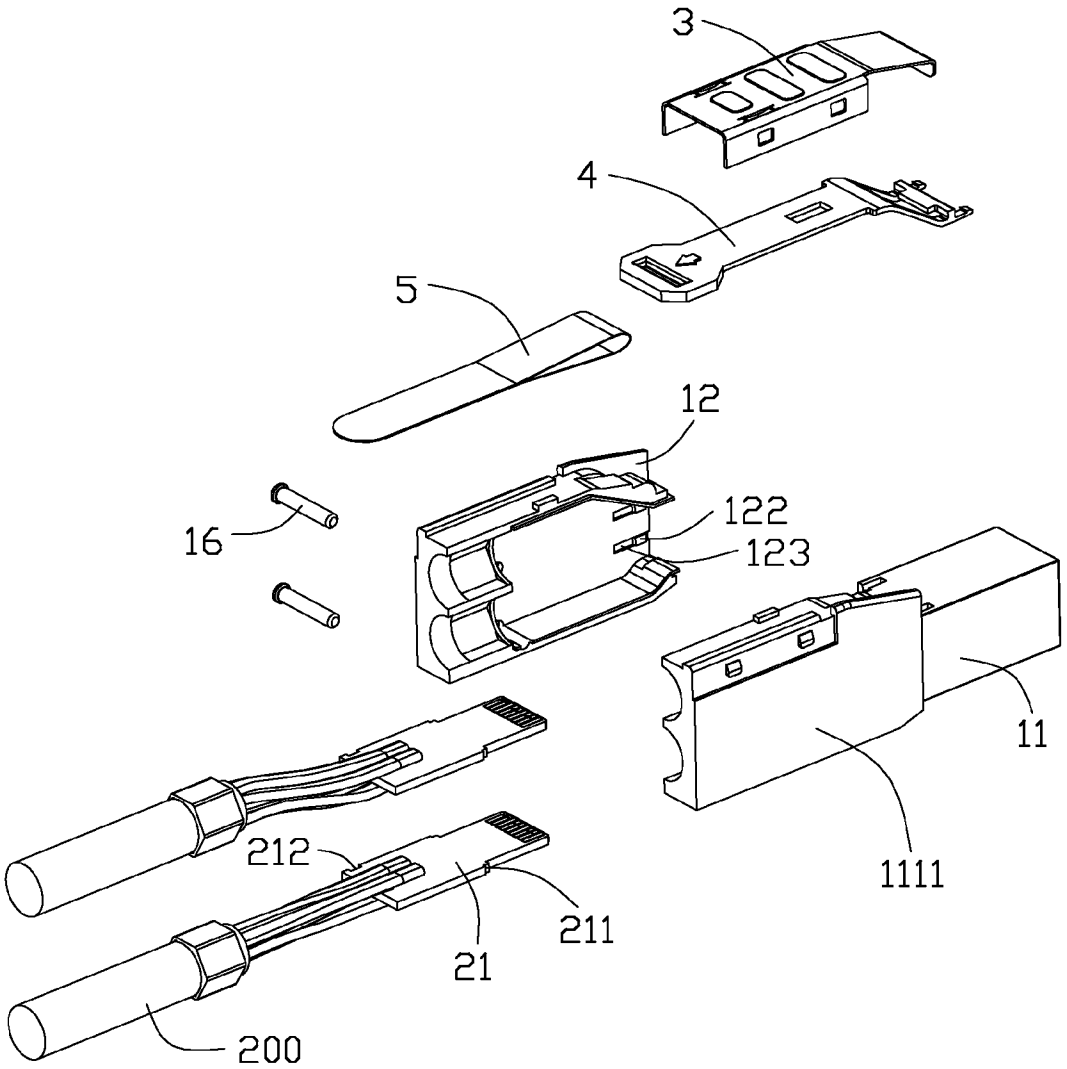
FIG. 3 is another exploded perspective view similar to FIG. 2, taken from another aspect.

Referring to FIGS. 3-5, the second housing portion 12 has two engaging slots 123, and two engaging portions 122 each disposed in a corresponding engaging slot 123.

In conjunction with FIG. 2, each paddle board 21 defines an engaging recess 212 engaged with a corresponding engaging portion 122 of the second housing portion 12 and a stepped portion 211 in front of the engaging recess 212.

Referring to FIGS. 1-5, in assembling of the housing and the paddle boards 21, the two paddle boards 21 connected with the cables 200 are guided by the rear portions of the first channels 112*a* and are inserted into the cavity 13 through the first and second channels 112*a*, 112*b* along a back-to-front direction. Each paddle board 21 is inserted to a predetermined position when the stepped portions 211 are engaged with the blocking portions 1121. The second housing portion 12 is then attached to the first housing portion 11 along a left-to-right direction perpendicular to the back-to-front direction in alignment with the second side wall 1112. The engaging recess 212 of each paddle board 21 is engaged with a corresponding engaging portion 122 of the second housing portion 12. A rear edge of each paddle board 21 is confined in a corresponding engaging slot 123. Two pins 16 are respectively inserted into the locking posts 119 through the locking holes 121 for locking the first and second housing portions 11, 12 together. The second housing portion 12 engages with the first housing portion 11 for strengthening the confinement of the two paddle boards 21 between the first and second housing portions 11 and 12.

The assembled housing includes a top face 1115, an upper face 1113 lower than the top face 1115, and a slope 113 between the top face 1115 and the upper face 1113. The housing has a receiving recess 118 defined in the top face 1115, and a tab 115 formed in the receiving recess 118. The slope 113 has a pair of inclining recesses 116 defined at two opposite sides thereof and a projecting portion 1131 formed between the pair of inclining recesses 116. The housing has a platform 110 formed on the upper face 1113, and two slits 117 recessed downwardly from the upper face 1113. The housing further includes a plurality of locking protrusions 15 formed on outer faces of the first and second housing portions 11, 12.

The releasing mechanism includes a latch 4 and a puller 5 detachably mounted with each other in this embodiment or integrally formed into one piece in another embodiment.

The latch 4 includes a body portion 41 defining a mounting slot 412 at a rear portion thereof and a sliding recess 411 in a substantially middle portion thereof The latch 4 further includes a latching portion 42 having a pair of beams 422 connected with the body portion 41, a resisting portion 423 connected with the pair of beams 422, and a pair of upwardly projecting claws 424 formed in front of the resisting portion 423.

The cover 3 comprises a flat top wall 31, a pair of side walls 34 extending from two opposite side edges of the top wall 31, a tongue wall 32 extending forwardly from a front edge of the top wall 31, an abutting portion 33 extending downwardly from the tongue wall 32, and a plurality of locking holes 35 defined in the side walls 34.

Referring to FIGS. 1-5, when the releasing mechanisms and the cover 3 are assembled to the housing, the latch 4 is received in receiving recess 118. The tab 115 is slidable in the sliding recess 411. The pair of beams 422 are received in the inclining recesses 116. The pair of claws 424 are disposed above the slits 117. The puller 5 is mounted in mounting slot 412 of the latch 4. The cover 3 is attached to the housing for covering the latch 4, with the locking holes 35 locked with the locking protrusions 15. The resisting portion 423 is secured between the platform 110 and the abutting portion 33.

When the body portion 41 of the latch 4 is pulled rearwardly by the puller 5, the latching portion 42 is pivoted about the resisting portion 423, with the resisting portion 423 abutting against the projecting portion 1131. The pair of claws 424 are moved downwardly from a latched position to the released position into the latching recesses 117. The tab 115 slides in the sliding recess 411.

The paddle boards 21 could be inserted along the first and second channels 112*a*, 112*b* of the first housing portion 112*a* directly without any supporting member. The paddle boards 21 could also be confined between the first and second housing portions 11, 12 and locked by the engaging portions 122 of the second housing portion 12 reliably. It is easy to mount the paddle boards 21 in the housing reliably.

Figure 6:
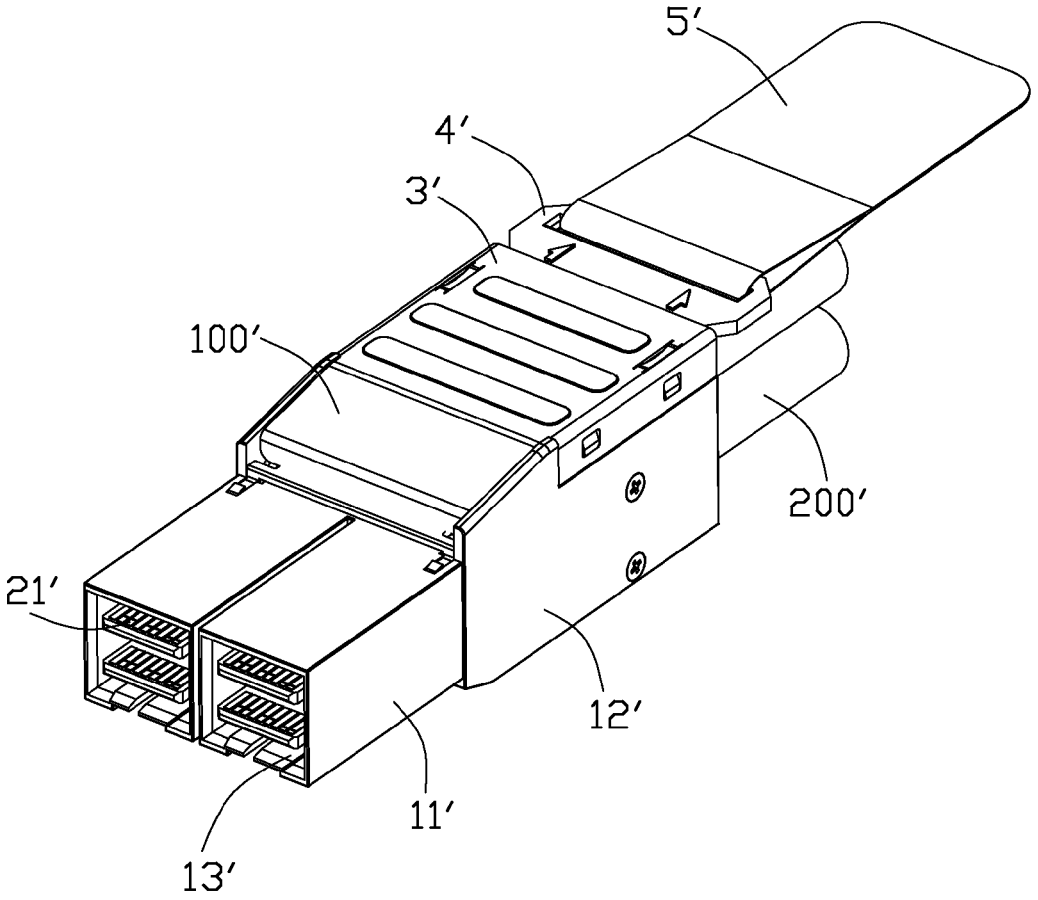
FIG. 6 is a perspective view of the plug connector referred in a second embodiment.
Figure 7:
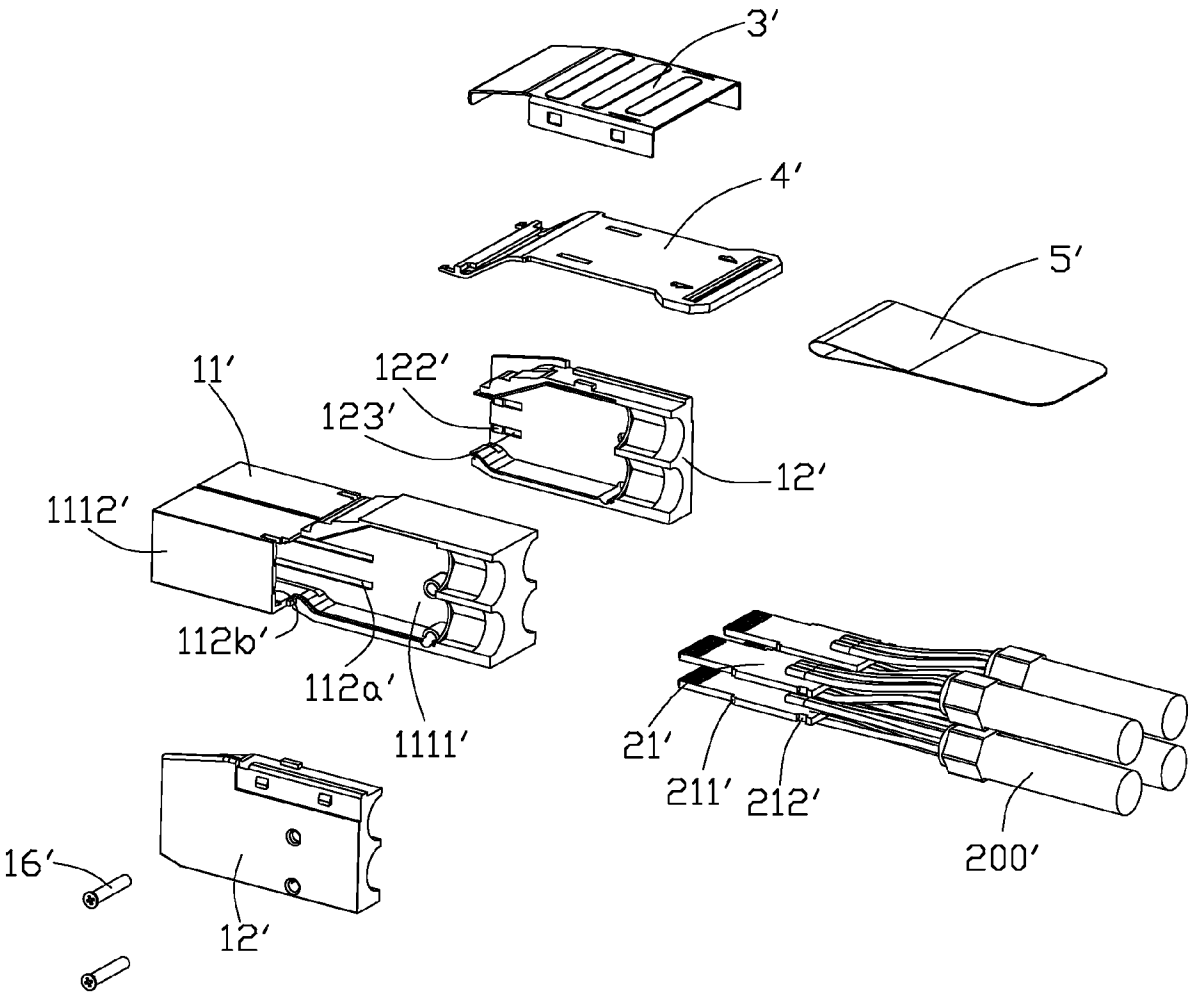
FIG. 7 is an exploded view of the plug connector shown in FIG. 6.

Referring to FIGS. 6 and 7, in a second embodiment, the housing comprises a first housing portion 11' and two second housing portions 12' engaged with the first housing portion 11'. Both the first housing portion 11' and the second housing portions 12' are preferably die-casted.

The first housing portion 11 includes a first side wall 1111' having two opposite inner faces (not labeled), two second side walls 1112' respectively opposite to a front portion of the first side wall 1111', and two cavities 13' each defined between the front portion of the first side wall 1111' and a corresponding second side wall 1112' to receive the two paddle boards 21'. Each inner face of the first side wall 1111' of the first housing portion 11' defines two first channels 112*a*' each having a front portion exposed to the cavity 13' and a rear portion exposed outwardly of the cavity 13'. Each second side wall 1112' of the first housing portion 11' defines two second channels 112*b*' exposed to the cavity 13'.

Each second housing portion 12' has two engaging slots 123', and two engaging portions 122' each disposed in a corresponding engaging slot 123'.

Each paddle board 21' defines an engaging recess 212' engaged with a corresponding engaging portion 122' of a corresponding second housing portion 12', and a stepped portion 211' in front of the engaging recess 212'.

In assembling of the housing and the paddle boards 21', two paddle boards 21' connected with the cables 200' are guided by the rear portions of the first channels 112*a*' and are inserted into each cavity 13' through the first and second channels 112*a*', 112*b*' along the back-to-front direction. Each paddle board 21' is inserted to a predetermined position when the stepped portions 211' are engaged with two blocking portions (not shown) formed in the first and second channels 112*a*', 112*b*'. Two second housing portions 12' are then attached to two opposite sides of the first housing portion 11' along the left-to-right and right-to-left directions, respectively. The engaging recess 212' of each paddle board 21' is engaged with a corresponding engaging portion 122' of a corresponding second housing portion 12'. A rear edge of each paddle board 21' is confined in a corresponding engaging slot 123'. A plurality of pins 16 are respectively inserted into the locking posts 119 through the locking holes 121 for locking the second housing portions 12' onto the first housing portion 11'.

The plug connector 100' referred in the second embodiment has a cover 3', a latch 4' and a puller 5' substantially same to that of the plug connector 100 referred in the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

at least one paddle board; and a housing comprising a first housing portion and a second housing portions, said first housing portion including a first side wall defining at least one first channel, a second side wall opposite to the first side wall and defining at least one second channel, and a cavity defined between a front portion of the first side wall and the second side wall, said at least one first channel having a front portion exposed to the cavity and a rear portion exposed outwardly of the cavity, said at least one paddle board having a length smaller than of said at least one first channel and larger than that of said at least one second channel, said at least one paddle board being guided by the rear portion of the at least one first channel and inserted into the cavity along the at least one first channel and the at least one second channel, the second housing portion engaged with the first housing portion along a left-to-right direction to be in alignment with the second side wall for positioning the at least one paddle board between the first and second housing portions.

2. The plug connector as claimed in claim 1, wherein there are two paddle boards, and there are two first channels defined in the first side wall and two second channels defined in the second side wall for insertion of the two paddle boards.

3. The plug connector as claimed in claim 2, wherein each paddle board has two stepped portions, and each of the first channel and the second channel has a blocking portion engaged with a corresponding stepped portion.

4. The plug connector as claimed in claim 2, wherein said second housing portion has two engaging portions, and each paddle board defines an engaging recess engaged with a corresponding engaging portion of the second housing portion.

5. The plug connector as claimed in claim 4, wherein said second housing portion defines two engaging slots, each engaging portion being formed in a corresponding engaging slot, each paddle board having a rear edge confined in a corresponding engaging slot of the second housing portion.

6. The plug connector as claimed in claim 2, wherein one of said second housing portion and the first side wall of the first housing portion has a locking hole, and another one of said second housing portion and the first side wall of the first housing portion has a locking post, said plug connector having a pin inserted into the locking post through the locking hole for locking the first and second housing portions together.

7. The plug connector as claimed in claim 1, wherein said first housing portion includes a first side wall having two opposite inner faces, a pair of second side walls opposite to a front portion of the first side wall, and two cavities each defined between the front portion of the first side wall and a corresponding second side wall to receive the at least one paddle board.

8. The plug connector as claimed in claim 7, wherein there are two first channels defined in each inner face of the first side wall and two second channels defined in each second side wall for insertion of two paddle boards.

9. The plug connector as claimed in claim 8, wherein each paddle board has two stepped portions, and each of the first channel and the second channel has a blocking portion engaged with a corresponding stepped portion to insert the paddle board to a predetermined position.

10. The plug connector as claimed in claim 8, further comprising another second housing portion symmetrically formed with said second housing portion, each second housing portion having two engaging portions, each paddle board defining an engaging recess engaged with a corresponding engaging portion.

11. An electrical connector comprising:

a unitary housing defining a front frame section and a first rear half side portion in a front-to-back direction;

a second rear half side portion discrete from the housing while being adapted to be assembled to the first rear half side portion in a transverse direction perpendicular to said front-to-back direction to form a subassembly;

first and second front guide channels arranged opposite to each other in said transverse direction, and formed in a pair of opposite interior faces of the front frame section;

a first rear guide channel formed in an interior surface of the first rear half side portion and in alignment with the first front guide channel in the front-to-back direction;

a second rear guide channel formed in another interior surface of said second rear half side portion and in alignment with the second front guide channel in the front-to-back direction; and a printed circuit board extending in a plane defined by said front-to-back direction and said transverse direction, and disposed in the subassembly with two opposite side edges engaged within the first and second front guide channels and the first and second rear guide channels; wherein rear end regions of said first and second rear half side portions are configured and dimensioned to allow said printed circuit board not to be forwardly assembled into the subassembly in the front-to-back direction but to be sideward assembled into the subassembly in the transverse direction before said the second rear half side portion is assembled to said first rear half side portion.

12. The electrical connector as claimed in claim 11, wherein a notch is formed in one of the two opposite side edges to receive an engaging portion formed in the second rear guide channel so as to secure the printed circuit board in the subassembly without relative movement in the front-to-back direction.

13. The electrical connector as claimed in claim 11, further including another housing essentially identical to the housing and unitarily formed with the housing in the transverse direction to have the first rear half side portions said two housings joined together while the front frame sections of said two housings are essentially separate from each other.

14. The electrical connector as claimed in claim 11, wherein a latch located upon an exterior face of the housing and back and forth moveable relative to the housing in the front-to-back direction under condition that said latch extends in a plane defined by said front-to-back direction and said transverse direction while a claw formed on a front end region of the latch is moveable in a vertical direction perpendicular to both said front-to-back direction and said transverse direction.

15. The electrical connector as claimed in claim 14, wherein a cover is attached to both said first and second rear half side portions to cooperate with both said first and second rear half side portions to sandwich the latch therebetween.

16. The electrical connector as claimed in claim 11, wherein a cable connects to a rear end region of the printed circuit board, and said rear end regions of both said first and second rear half side portions are configured and dimensioned to allow said cable to extend rearwardly therefrom.

17. The electrical connector as claimed in claim 14, wherein a slit is formed in a rear portion of the front frame section to receive the claw therein.

* * * * *